US011696625B2

(12) United States Patent
McCoury

(10) Patent No.: US 11,696,625 B2
(45) Date of Patent: Jul. 11, 2023

(54) PRAYER DEVICES

(71) Applicant: My Mission Message LLC, Charlotte, NC (US)

(72) Inventor: Melissa Lyn McCoury, Charlotte, NC (US)

(73) Assignee: MY MISSION MESSAGE, LLC, Charlotte, NC (US)

( * ) Notice: Subject to any disclaimer, the term of this patent is extended or adjusted under 35 U.S.C. 154(b) by 686 days.

(21) Appl. No.: 16/299,468

(22) Filed: Mar. 12, 2019

(65) Prior Publication Data

US 2019/0281933 A1 Sep. 19, 2019

Related U.S. Application Data

(60) Provisional application No. 62/642,266, filed on Mar. 13, 2018.

(51) Int. Cl.
*A44C 23/00* (2006.01)

(52) U.S. Cl.
CPC ..... *A44C 23/00* (2013.01)

(58) Field of Classification Search
CPC ..... A44C 23/00; A44C 25/00; A44C 3/008; A44C 25/007
USPC ..... 434/246
See application file for complete search history.

(56) References Cited

U.S. PATENT DOCUMENTS

2004/0144131 A1* 7/2004 Enevoldsen ..... A44C 15/005 63/3
2013/0305782 A1* 11/2013 Butler ..... A44C 27/00 63/12

FOREIGN PATENT DOCUMENTS

WO WO 2017/098761 * 6/2017 ..... A63B 71/06

OTHER PUBLICATIONS

"How to Make Basic Beaded Hoop Earrings," All About Beads, https://www.youtube.com/watch?v=VlhbskpJg_Q, Aug. 2, 2014 (Year: 2014).*
"Q&Locket Lobster Clasp Rolo Cable Chain Necklace Fit Living Memory Locket Pendant Necklace," Amazon.com, https://www.amazon.com/Locket-Lobster-Necklace-Living-Pendant/dp/B01M5FM37E, Oct. 25, 2016 (Year: 2016).*

* cited by examiner

*Primary Examiner* — Kurt Fernstrom
(74) *Attorney, Agent, or Firm* — Burr & Forman LLP

(57) ABSTRACT

Prayer devices are provide that include (i) a multi-point connector comprising a first-connecting-structure and a second-connecting-structure and (ii) a hoop-component including a first end and a second end, in which the first-connecting-structure is configured to releasably or permanently engage the first end of the hoop-component and the second-connecting-structure is configured to releasably engage the second end of the hoop-component. The prayer devices may also include at least one bead directly or indirectly mounted, such as slidably mounted, on the hoop-component.

19 Claims, 7 Drawing Sheets

PRAYER DEVICES

This application claims priority under 35 U.S.C. § 119(e) to U.S. Provisional Application Ser. No. 62/642,266, filed on Mar. 13, 2018, which is expressly incorporated by reference herein in its entirety.

TECHNICAL FIELD

Embodiments of the presently-disclosed invention relate generally to prayer devices, such as a rosary, that may be releasably clipped onto an article and carried about such that a user may be able to recite one or more prayers throughout the course of the day regardless of location.

BACKGROUND

Prayer devices including beads have been used in many traditions to keep count of the repetitions of prayers, recitations, chants, and devotions. Such prayer devices have been used broadly by a multitude of historical religions in every age. For instance, the Roman Catholic Rosary is a Scripture-based prayer that begins with the Apostles' Creed, which summarizes the great mysteries of the Catholic faith. The Our Father, which introduces each mystery, is from the Gospels. The first part of the Hail Mary is the angel's words announcing Christ's birth and Elizabeth's greeting to Mary. The Mysteries of the Roman Catholic Rosary center on the events of Christ's life. In this regard, there are four sets of Mysteries: (1) Joyful; (2) Sorrowful; (3) Glorious; and (4) Luminous. The repetition in the Roman Catholic Rosary is meant to lead one into restful and contemplative prayer related to each Mystery. The gentle repetition of the words is intended to facilitate individuals to enter into the silence of their hearts, where Christ's spirit dwells.

More specifically, the five Joyful Mysteries are: The Annunciation; The Visitation; The Nativity; The Presentation in the Temple; and The Finding in the Temple. The five Sorrowful Mysteries are: The Agony in the Garden; The Scourging at the Pillar; The Crowning with Thorns; The Carrying of the Cross; and The Crucifixion and Death. The five Glorious Mysteries are: The Resurrection; The Ascension; The Descent of the Holy Spirit; The Assumption; and The Coronation of Mary. The five Luminous Mysteries are: The Baptism of Christ in the Jordan; The Wedding Feast at Cana; Jesus' Proclamation of the Coming of the Kingdom of God; The Transfiguration; and The Institution of the Eucharist.

When praying the Roman Catholic Rosary, one initially makes the Sign of the Cross followed by holding the Crucifix while saying the Apostles' Creed. On the first bead, the individual says an Our Father and recites one Hail Mary on each of the next three beads.

The individual will then say the Glory Be. For each of the five decades, the individual announces the Mystery (perhaps followed by a brief reading from Scripture) then say the Our Father. While fingering each of the ten beads of the decade, the individual next says ten Hail Marys while meditating on the particular Mystery. After saying ten Then say Hail Marys the individual will say the Glory Be. After saying the five decades, an individual will say the Hail, Holy Queen.

The Apostles' Creed prayer is: I believe in God, the Father almighty, Creator of heaven and earth, and in Jesus Christ, his only Son, our Lord, who was conceived by the Holy Spirit, born of the Virgin Mary, suffered under Pontius Pilate, was crucified, died and was buried; he descended into hell; on the third day he rose again from the dead; he ascended into heaven, and is seated at the right hand of God the Father almighty; from there he will come to judge the living and the dead. I believe in the Holy Spirit, the holy catholic Church, the communion of saints, the forgiveness of sins, the resurrection of the body, and life everlasting. Amen.

The Our Father prayer is: Our Father, who art in heaven, hallowed be thy name;

thy kingdom come; thy will be done on earth as it is in heaven. Give us this day our daily bread; and forgive us our trespasses as we forgive those who trespass against us; and lead us not into temptation, but deliver us from evil. Amen The Hail Mary prayer is: Hail Mary, full of grace, the Lord is with you; blessed are you among women, and blessed is the fruit of your womb, Jesus. Holy Mary, Mother of God, pray for us sinners now and at the hour of our death. Amen.

The Glory Be (The Doxology) prayer is: Glory be to the Father, the Son, and the Holy Spirit; as it was in the beginning, is now, and ever shall be, world without end. Amen.

The Hail Holy Queen (The Salve Regina) prayer is: Hail, holy Queen, mother of mercy, our life, our sweetness, and our hope. To you we cry, poor banished children of Eve; to you we send up our sighs, mourning and weeping in this valley of tears. Turn, then, most gracious advocate, your eyes of mercy toward us; and after this, our exile, show unto us the blessed fruit of your womb, Jesus. O clement, O loving, O sweet Virgin Mary.

In this regard, prayer beads are a particularly important part of many individual's daily routines. However, traditional prayer devices are generally not configured to provide ease of use throughout the course of a given time period while a user may be traveling and/or changing accessories (e.g., purses, bags, etc.).

Therefore, there remains a need in the art for prayer devices, such as a rosary, that may be releasably clipped onto a variety of articles and carried about such that a user may be able to recite one or more prayers throughout the course of a given time period regardless of location and/or changing of accessories (e.g., purses, bags, etc.) during the given time period.

SUMMARY OF INVENTION

One or more embodiments of the invention may address one or more of the aforementioned problems. Certain embodiments according to the invention provide prayer devices that may be clipped onto an article, such a personal article, and carried about by a user. In accordance with certain embodiments of the invention, the prayer device may be releasably clipped onto a personal article (e.g., a purse) and easily transported along with the user throughout the day. In this regard, the prayer device may be detached from the personal article at any desired time for facilitating the recitation of one or more prayers. Moreover, the attachability/detachability of the prayer devices enable a user to conveniently attach the prayer device to different articles throughout a period of time (e.g., a morning, afternoon, day, weekend, etc.). For example, an individual may utilize several different purses or bags (e.g., backpack, gym bag, etc.) throughout a given time period (e.g., a morning, afternoon, day, weekend, etc.) and the prayer device may be easily switched from one item to the next via, for example, the attaching/detaching feature (as discussed herein) of the prayer device. The prayer devices, in accordance with certain embodiments of the invention, facilitate easy and/or convenient tracking, locating, and/or transferring of the prayer device throughout a time period, such as a time period in which more than one personal article (e.g., purse, bag, etc.) is used or carried by an individual wishing to retain custody of a prayer device throughout this time period. In this regard, the prayer device may actually facilitate an increased frequency of reciting one or more prayers. In accordance with certain embodiments of the invention, for instance, the prayer devices comprise a multi-point connector comprising a first-connecting-structure and a second-connecting-structure. The prayer devices may also comprise a hoop-component including a first end and a second end, in which the first-connecting-structure may be configured to releasably or permanently engage the first end of the hoop-component and the second-connecting-structure may be configured to releasably engage the second end of the hoop-component. The prayer devices may also include at least one bead directly or indirectly mounted, such as slidably mounted, on the hoop-component.

BRIEF DESCRIPTION OF THE FIGURE(S)

The invention now will be described more fully hereinafter with reference to the accompanying figures, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout, and wherein.

DETAILED DESCRIPTION

The invention now will be described more fully hereinafter with reference to the accompanying figures, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The presently-disclosed invention relates generally to prayer devices that may be readily and removably clipped onto a variety of inanimate objects (e.g., personal articles including bags, appliances, automobiles, clothes, etc.) and easily transported along with the user throughout a given time period (e.g., a portion of a day, a weekend, a week, etc.). In this regard, the prayer device may be detached from the inanimate object at any time desired for facilitating the recitation of one or more prayers. In accordance with certain embodiments of the invention, for instance, the prayer devices may comprise a multi-point connector comprising a first-connecting-structure and a second-connecting-structure. The prayer devices may also comprise a hoop-component (e.g., integral with the multi-point connector or a separate and distinctly different material or component from the multi-point connector) comprising a first end and a second end, in which the first-connecting-structure may be configured to releasably or permanently engage the first end of the hoop-component and the second-connecting-structure may configured to releasably engage the second end of the hoop-component. In this regard, the second end of the hoop-component may be engaged and/or disengaged with the second-connecting-structure to provide the hoop-component of the prayer device in an open-state (e.g., when the second end of the hoop-component is disengaged with the second-connecting-structure) or in a closed-state (e.g., when the second end of the hoop-component is engaged with the second-connecting-structure). In accordance with certain embodiments of the invention, for example, this feature provides at least one aspect of "clipping" or "clippable" functionality to the prayer devices. The prayer devices may also comprise at least one bead (e.g., 1, 2, 3, 4, 5, 6, 7, 8, 9, 10, 11, 12, 13, 14, 15, etc.) directly or indirectly mounted, such as slidably mounted, on the hoop-component. For example the bead or beads may each comprise a conduit or though-channel extending through at least a portion (e.g., completely through one dimension of the bead) of the bead in question. In this regard, the conduit or though-channel may be configured such that the hoop-component may be passed through the conduit or through-channel to support the bead or beads on the hoop-component.

Figure 1:
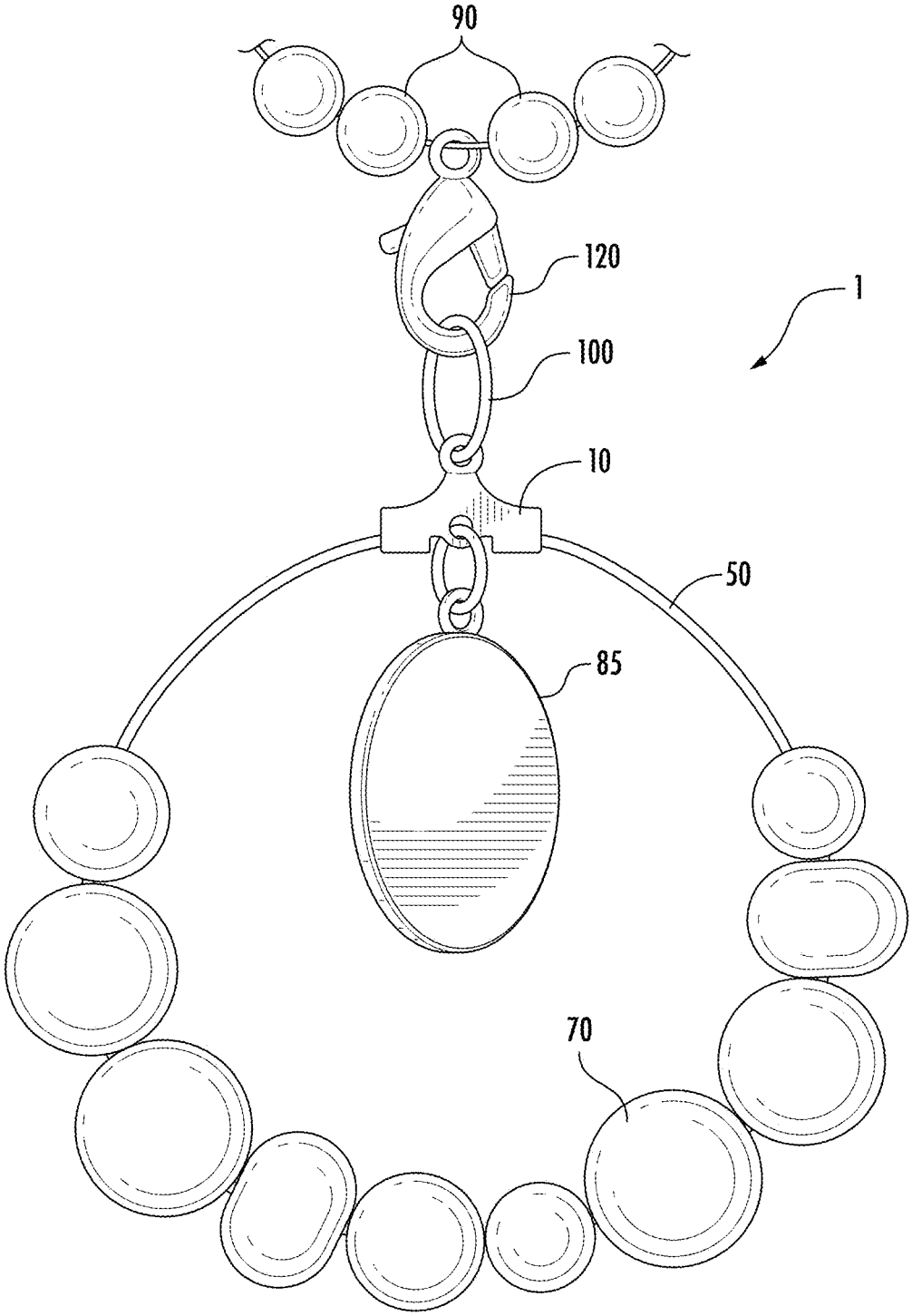
FIG. 1 illustrates a prayer device in accordance with certain embodiments of the invention.

As shown in FIG. 1, a prayer device 1 in accordance with certain embodiments of the invention may comprise a multi-point connector 10 and a hoop component 50. FIG. 1 illustrates the prayer device 1 in which the hoop-component 50 is provided in a closed-state as both ends of the hoop-component are engaged with the multi-point connector 10. The embodiment shown in FIG. 1 includes ten (10) beads 70 that are mounted on the hoop-component 50. FIG. 1 also illustrates an embodiment of the invention that includes a plurality of pendants/religious symbols 85 that are attached to the multi-point connector 10. As discussed in greater detail below, the pendants/religious symbols 85 may be attached to the multi-point connector 10 at a location separate and distinct from the locations in which the hoop-component 50 is attached/engaged with the multi-point connector. The embodiment illustrated by FIG. 1 also comprises an optional flexible cord 90 including a plurality of decorative beads thereon. The optional flexible cord 90 in the particular embodiment illustrated is indirectly attached to the multi-point connector 10 via coupling-link 100 and a manually opening/closing connector (e.g., a claw clip) 120. The manually opening/closing connector (e.g., a claw clip)

120 may be opened to separate the optional flexible cord 90 from the rest of the prayer device 1.

Figure 2:
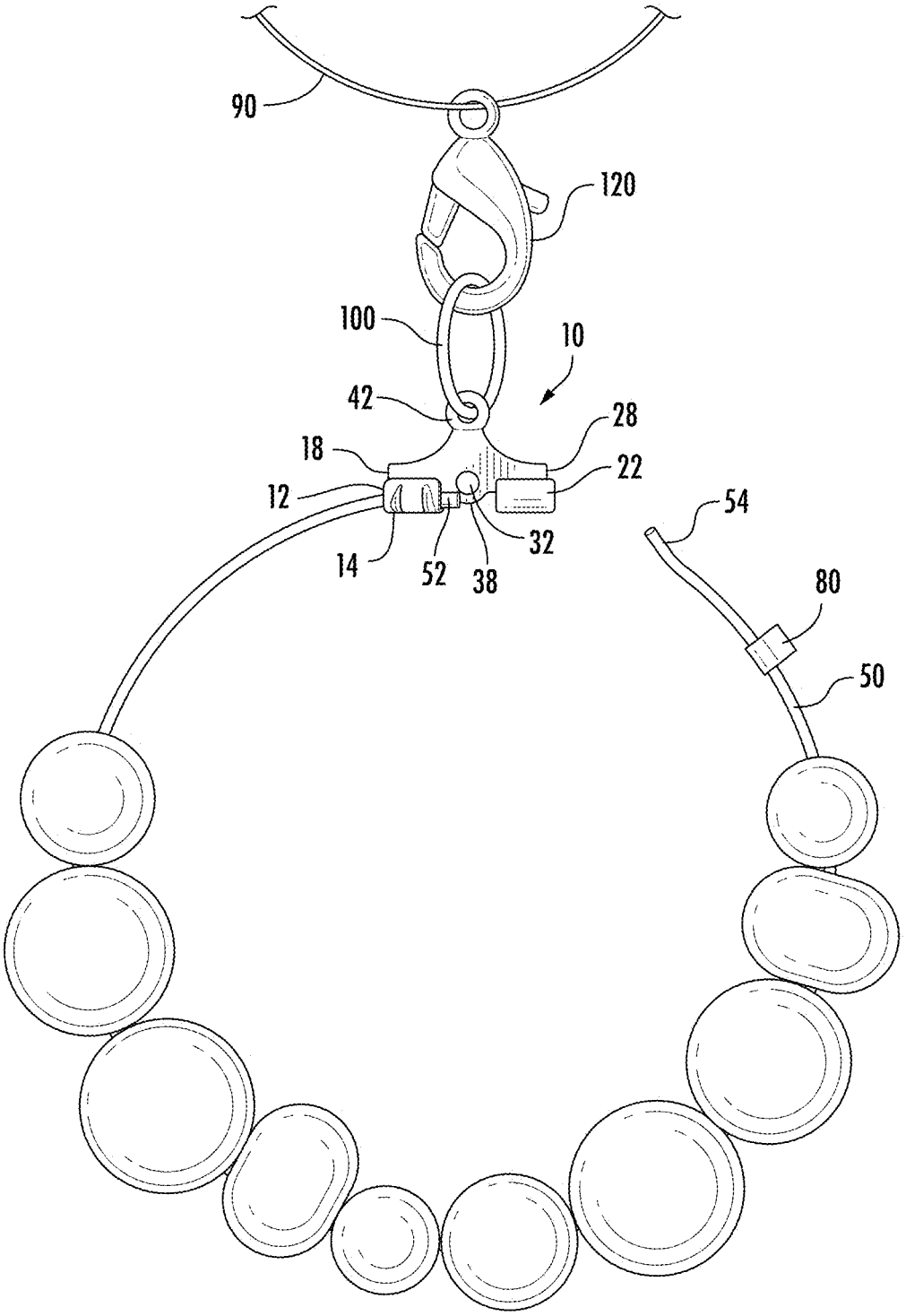
FIG. 2 illustrates a prayer device in accordance with certain embodiments of the invention, in which the hoop-component is disengaged from the multi-point connector such that that hoop-connector of the prayer device is in an open-state.
Figure 3:
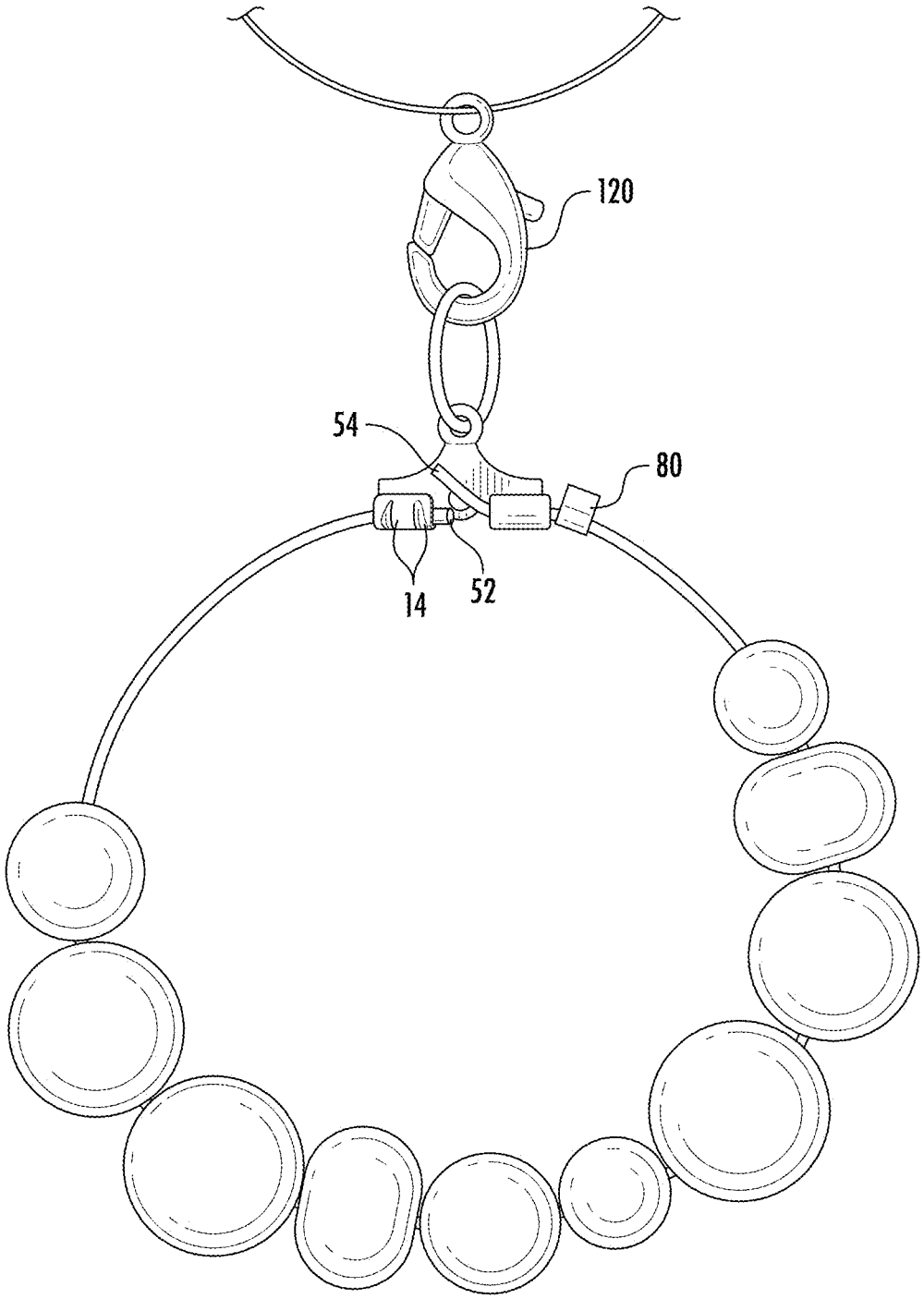
FIG. 3 illustrates the prayer device of FIG. 2, in which the hoop-component is engaged with the multi-point connector such that that hoop-component of the prayer device is in a closed-state.

FIG. 2 illustrates a prayer device in accordance with certain embodiments of the invention, in which the hoop-component 50 is disengaged from the multi-point connector 10 such that that hoop-connector of the prayer device is in an open-state. FIG. 3 illustrates the prayer device of FIG. 2, in which the hoop-component 50 is engaged with the multi-point connector 10 such that that hoop-component of the prayer device is in a closed-state. As also shown in FIG. 2, the multi-point connector 10 includes a first-connecting-structure 12 that is engaged with a first end 52 of the hoop-component 50 and a second-connecting-structure 22 that is not engaged with a second end 54 of the hoop-component 50. As noted above, FIG. 3 illustrates the prayer device 1 in a closed-state in which the second end 54 of the hoop-component extends into and optionally completely through the second-connecting-structure 22 (e.g., a female-attachment structure such as a conduit or trough). As shown in FIG. 2, the first-connecting-structure 12 and the second-connecting-structure 22 are separate and distinct from each other (e.g., separate and distinct structures). In this regard, the first-connecting-structure 12 and the second-connecting-structure 22 may be located at diametrically opposed end-portions 18,28 of the multi-point connector 10. Although FIG. 2 illustrates an embodiment in which the first-connecting-structure 12 and the second-connecting-structure 22 are separate and distinct from each other, certain embodiments of the invention may comprise a structural configuration in which the first-connecting-structure 12 and the second-connecting-structure 22 comprise an integral component (e.g., a unitary structure, such as a single elongated conduit or single elongated rod).

In accordance with certain embodiments of the invention, the first-connecting-structure 12 may comprise a first-female attachment structure being configured to receive the first end 52 of the hoop-component. The first-connecting-structure 12, for example, may be configured to permanently engage the first end 52 of the hoop-component, particularly in comparison to the first-connecting-structure 22. For example, the first-connecting-structure 12 may be configured to permanently engage the first end 52 of the hoop-component via (i) one or more crimps 14 forming an inwardly deformed portion of the first-connecting structure configured to mechanically engage and compress the first end of the hoop-component defining a corresponding deformed portion of the first end of the hoop-component; (ii) adhesive disposed between the first-connecting-structure and the first end of the hoop-component; (iii) a soldered portion between the first-connecting-structure and the first end of the hoop-component; or (iv) any combination thereof. In this regard, FIGS. 2 and 3 each illustrate an embodiment in which the first-connecting-structure 12 includes one or more crimps 14 to engage and lock onto the first end 52 of the hoop-component. The crimps 14, for instance, may define compressions of small folds, ridges, or waves into the first-connecting-structure 12 that engage and may also impart similar folds, ridges, or waves in the first end 52 of the hoop-component to restrict movement of the first end 52 of the hoop-component relative to the first-connecting-structure 12. In this regard, the crimps 14 may prohibit or facilitate resistance to disengagement or separation of the first-connecting-structure 12 and the first end 52 of the hoop-component. In accordance with certain embodiments of the invention, the second-connecting-structure 22 may comprise a second-female attachment structure being configured to receive the second end 54 of the hoop-component.

In accordance with certain embodiments of the invention, a first-external force required to disengage the first end 52 of the hoop-component from the first-connecting structure 12 is greater than a second-external force required to disengage the second end 54 of the hoop-component from the second-connecting structure 22.

Figure 4:
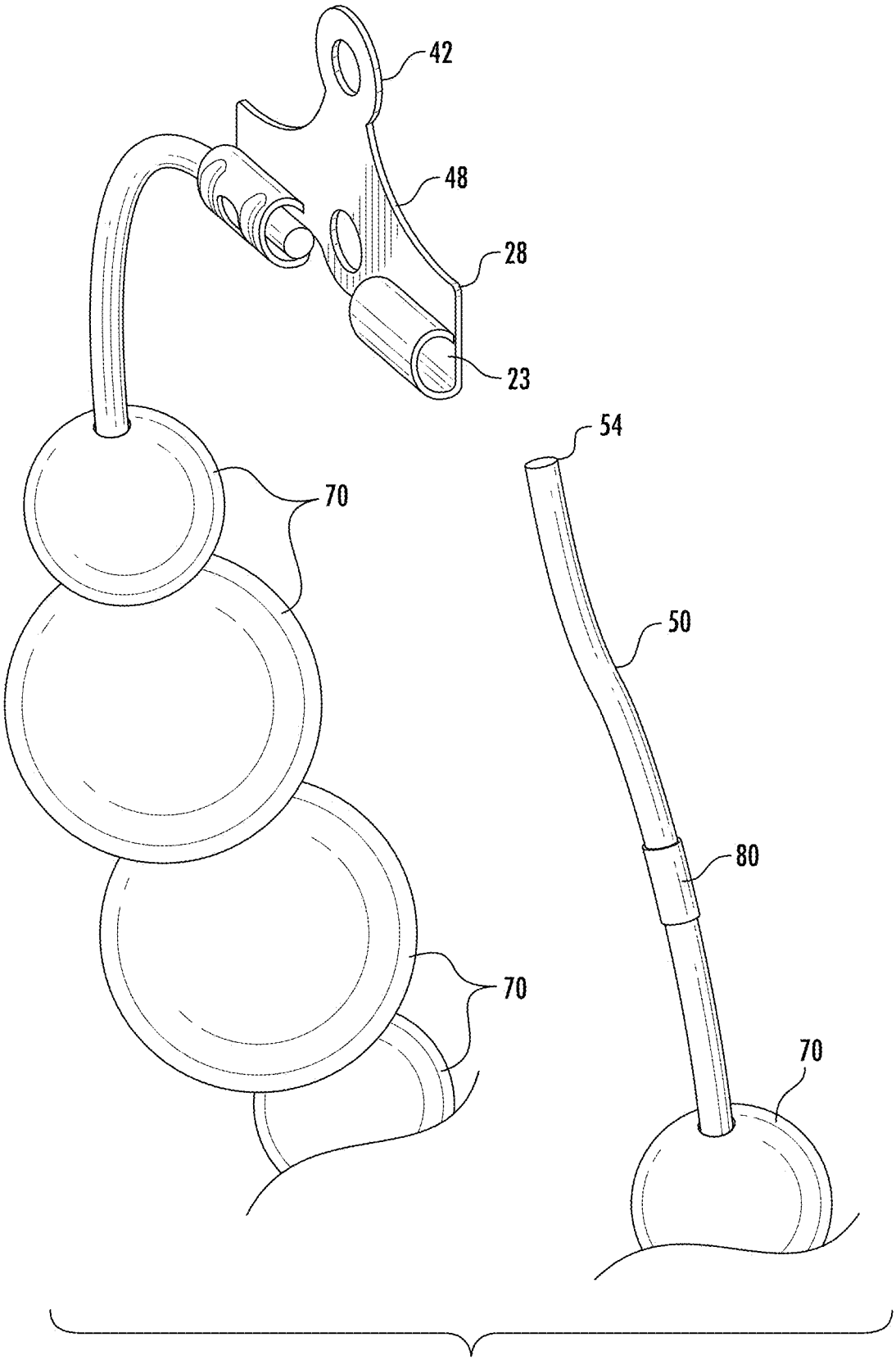
FIG. 4 shows a connecting-structure of the multi-point connector of the prayer device of FIG. 2, in which the second-connecting-structure comprises a conduit configured to receive a corresponding portion of the hoop-component.

In accordance with certain embodiments of the invention, the first-connecting-structure 12, the second-connecting-structure 22, or both may comprise a conduit or trough configured to receive the corresponding end of the hoop-component. FIG. 4, for example, shows the second-connecting-structure 22 of the multi-point connector 10 structurally configured as a conduit 23 that may receive the second end 54 of the hoop-component. In this regard, the second end 54 of the hoop-component may extend at least partially into the second-connecting-structure 22 or completely through the second-connecting-structure (as shown in FIG. 3).

Although the figures have illustrated embodiments that include a multi-point connector including a first-connecting-structure and a second-connecting-structure that comprise female-attachment structures, certain embodiments of the invention may comprise a multi-point connector in which (i) the first-connecting-structure comprises a first-male attachment structure being configured to be received within a first corresponding female portion of the hoop-component or a first-coupling component configured to receive the first-male attachment structure and the first end of the hoop-component and/or (ii) the second-connecting-structure comprises a second-male attachment structure being configured to be received within a second corresponding female portion of the hoop-component or a second-coupling component configured to receive the second-male attachment structure and the second end of the hoop-component.

As shown in FIG. 2-4 and discussed above, the prayer device 1 may comprise at least one bead 70 (e.g., a plurality of individual beads directly or indirectly mounted on the hoop-component) mounted on the hoop-component 50. In accordance with certain embodiments of the invention, the prayer device 1 may comprise a plurality of individual beads 70 that may be slideably mounted onto the hoop-component 50. In this regard, the individual beads 70 may be able to slide along the length of the hoop-component 50. In accordance with certain embodiments of the invention, the prayer device 1 may further comprise a blocker 80 fixedly (e.g., soldered in place) or releasably (e.g., clamped or screw-mounted) mounted onto the hoop-component 50 and positioned between the at least one bead 70 and the second end 54 of the hoop-component. In this regard, the blocker may prevent the bead/beads 70 from sliding off the hoop-component 50 when the second end 54 of the hoop-component is disengaged from the second-connecting-structure 22.

In accordance with certain embodiments of the invention, the hoop-component may comprise a rigid or semi-rigid wire. For example, the hoop-component in accordance with certain embodiments of the invention may not be freely flexible in a manner similar to that of a string. In accordance with certain embodiments of the invention, for instance, the hoop-component may maintain a substantially identical or unchanged configuration upon rotation in any direction. To the contrary, a sting would change shape/orientation when rotated about one or more dimensions. The hoop-component, in accordance with certain embodiments of the invention, may comprises a metallic material, such as a pliable metallic material. In accordance with certain embodiments of the invention, the hoop-component may comprise one or more polymers.

Figure 5:
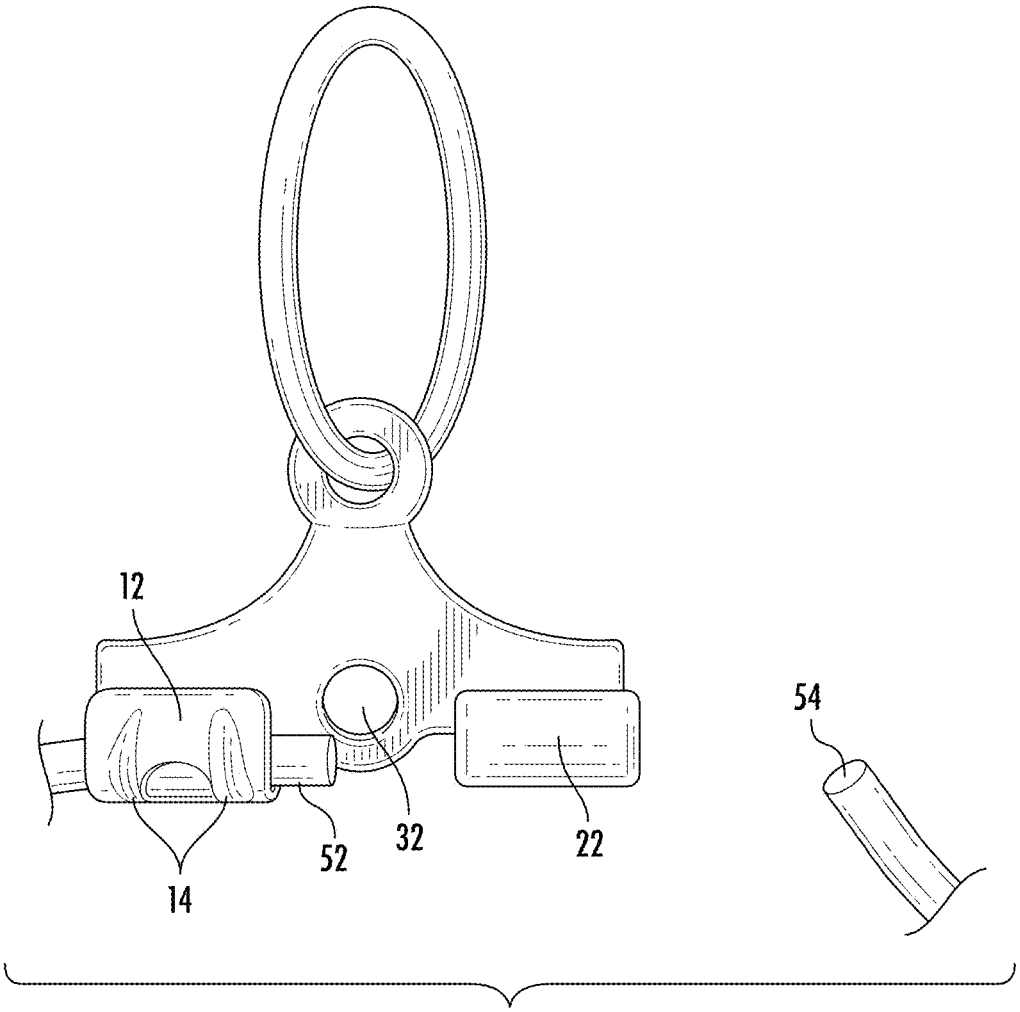
FIG. 5 shows a magnified view of the multi-point connector of the prayer device of FIG. 2.

FIGS. 4 and 5 show a magnified view of the multi-point connector 10 of the prayer device 1 of FIG. 2. The particular embodiment illustrated in FIGS. 4 and 5 includes a multi-point connector 10 that includes the first-connecting-structure 12, the second-connecting-structure 22, a third-connecting-structure 32, and a fourth-connecting-structure 42. As illustrated in the figures, the third-connecting-structure 32 of the multi-point connector 10 may be located on a bottom portion 38 of the multi-point connector. In accordance with certain embodiments of the invention, the third-connecting-structure 32 may be located between the first-connecting-structure 12 and the second-connecting-structure 22, such as centrally located between the first-connecting-structure and the second-connecting-structure. The third-connecting-structure 32 may comprise a third-female attachment structure being configured to receive one or more separate pendants, charms, chains, coupling-links, or combinations thereof. In accordance with certain embodiments of the invention, the third-connecting-structure 32 may comprise a ring-structure including a hole configured for direct or indirect engagement by one or more separate pendants, charms, chains, coupling-links, or combinations thereof. FIG. 1, for example, illustrates one or more separate pendants, charms, chains, coupling-links, or combinations thereof indirectly attached to the third-connecting-structure via a coupling-element.

In accordance with certain embodiments of the invention and as illustrated in FIGS. 2-5, the multi-point connector 10 may further comprise a top portion including a fourth-connecting-structure 42. In accordance with certain embodiments of the invention, the fourth-connecting-structure 42 may be located between the first-connecting-structure 12 and the second-connecting-structure 22, such as centrally located between the first-connecting-structure and the second-connecting-structure. In accordance with certain embodiments of the invention, the third-connecting structure 32 and the fourth-connecting-structure 42 may be aligned with each other in a vertical direction located, such as centrally, between the first-connecting-structure and the second-connecting-structure. In accordance with certain embodiments of the invention, the fourth-connecting-structure 42 comprises a fourth-female attachment structure being configured to receive one or more separate pendants, charms, chains, coupling-links, or combinations thereof. By way of example only, the fourth-connecting-structure 42 may comprise a top-ring-structure including a top-hole configured for direct or indirect engagement by one or more separate pendants, charms, chains, coupling-links, or combinations thereof. As shown in FIGS. 1-7, for example, the prayer device 1 may include a coupling-link 100 engaged through the top-hole and directly or indirectly attached to the one or more separate pendants, charms, chains, or combinations thereof. For example, the prayer device 1 may comprise an optional flexible cord 90 indirectly attached to the multi-point connector 10 via coupling link 100 and a manually opening/closing connector (e.g., a claw clip) 120. The manually opening/closing connector (e.g., a claw clip) 120 may be opened to separate the optional flexible cord 90 from the rest of the prayer device 1. In this regard, the manually opening/closing connector (e.g., a claw clip) 120 may be releasable engaged with the coupling-link 100. As shown in FIG. 1-7, for example, the prayer device 1 includes a flexible cord 90 configured in a loop. In accordance with certain embodiments of the invention, the flexible cord may be transparent to light. The flexible sting, in accordance with certain embodiments of the invention, may comprise a polymeric material (e.g., in fibers and/or extruded form), elastomeric material (e.g., in fibers and/or extruded form), a natural material (e.g., cotton or other natural-fiber containing material), or any combination thereof. The flexible cord, in accordance with certain embodiments of the invention, may comprise a percent stretchability from about 5% to about 50%. That is, the length of the flexible sting may be stretched by from about 5% to about 50% of its original length without breaking.

Figure 6:
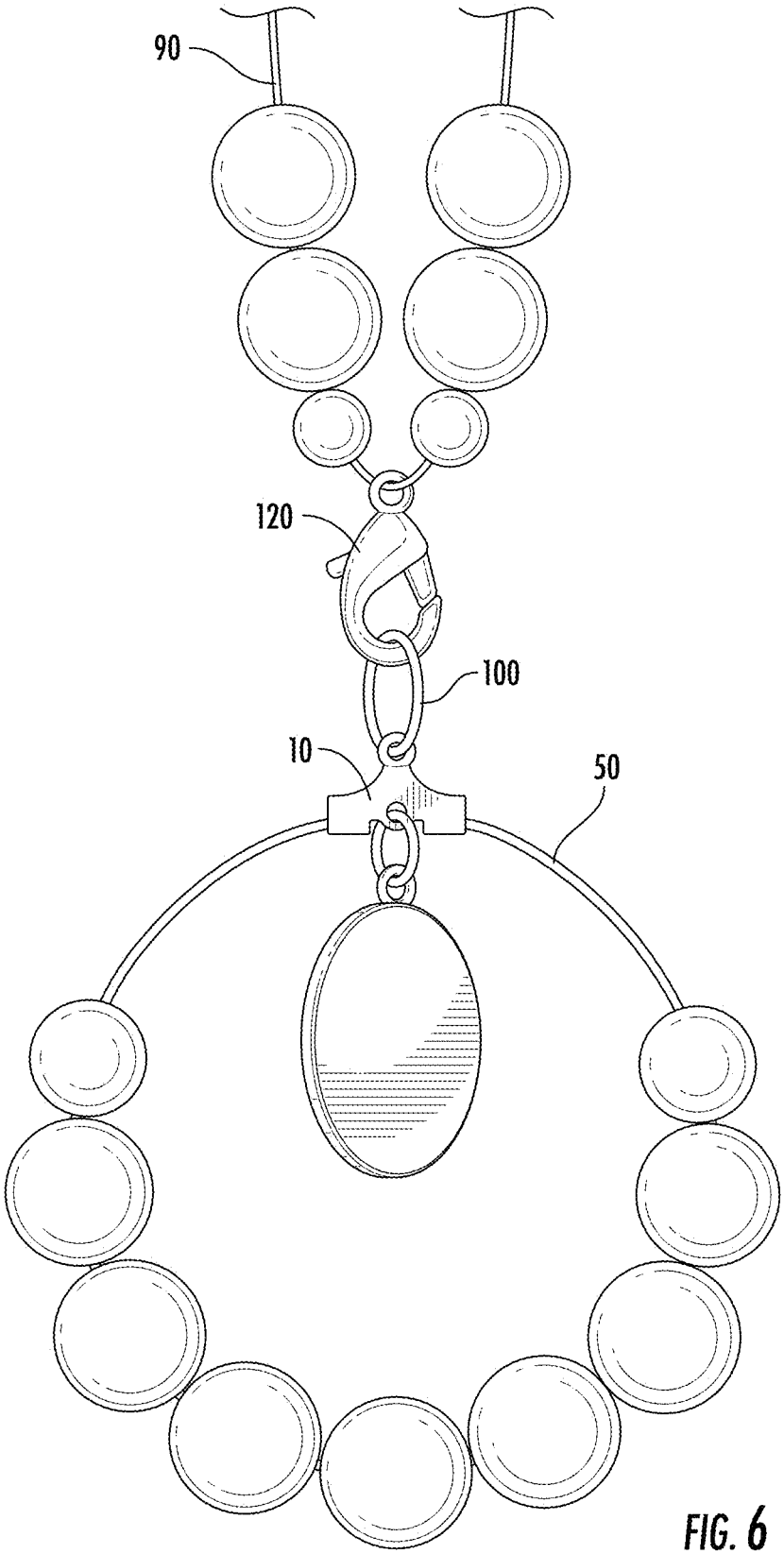
FIG. 6 illustrates a prayer device in accordance with certain embodiments of the invention, in which the prayer device is looped around a stationary object within an automobile.
Figure 7:
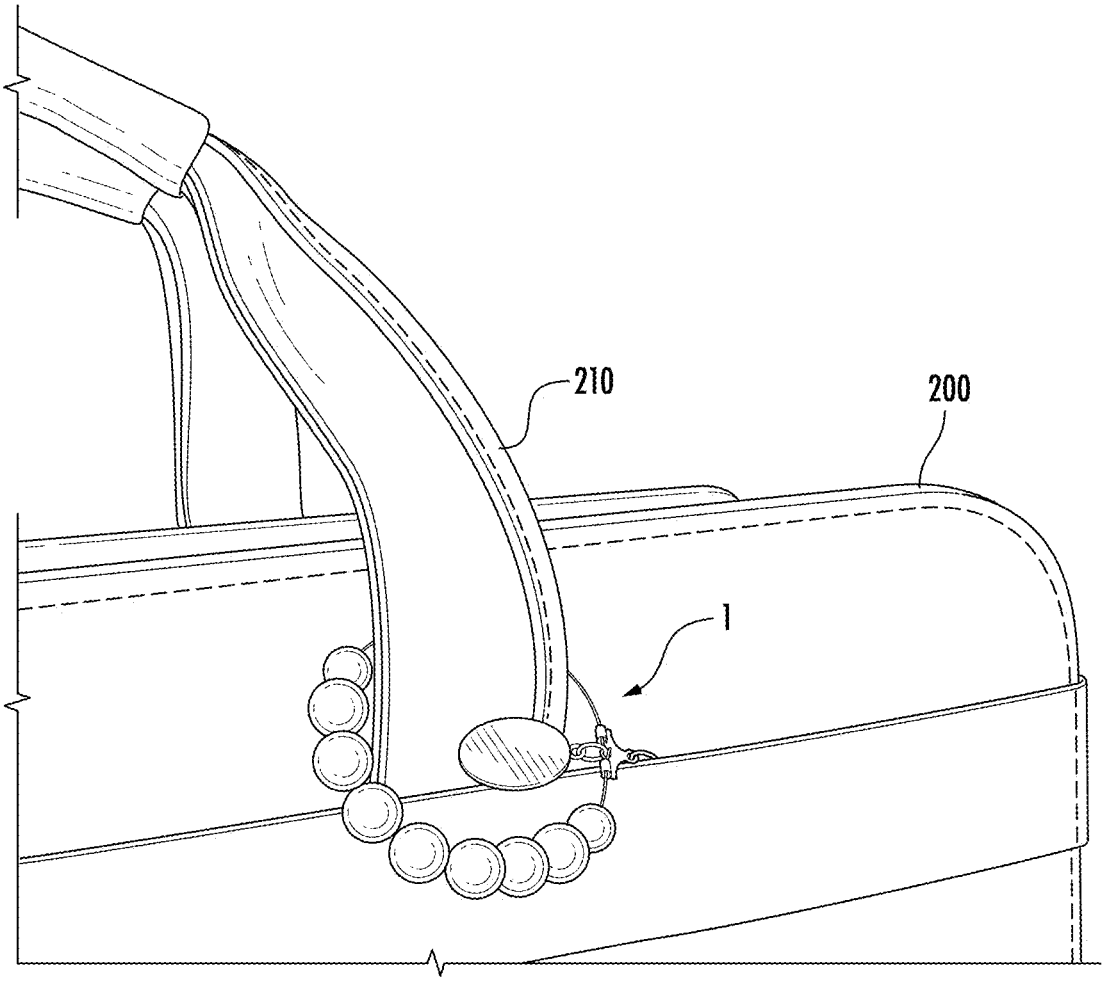
FIG. 7 illustrates the prayer device of FIG. 6, in which the prayer device has been clipped around the handle of a handbag.

FIG. 6 illustrates a prayer device 1 in accordance with certain embodiments of the invention, in which the prayer device is looped around a stationary object within an automobile via the optional flexible cord 90. As shown in FIG. 6, the flexible cord 90 includes a plurality of decorative beads mounted thereon. FIG. 7 illustrates the prayer device 1 of FIG. 6, in which the prayer device has been clipped around the handle of a handbag.

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

That which is claimed:

1. A prayer device, comprising:

(i) a multi-point connector comprising a first-connecting-structure and a second-connecting-structure;

(ii) a hoop-component comprising a first end and a second end; wherein the first-connecting-structure is configured to permanently engage the first end of the hoop-component and the second-connecting-structure is configured to releasably engage the second end of the hoop-component;

(iii) at least one bead directly or indirectly mounted on the hoop-component; and (iv) a blocker fixedly mounted onto the hoop-component and positioned between the at least one bead and the second end of the hoop-component; wherein the blocker prevents that at least one bead from sliding off the hoop-component when the second end of the hoop-component is disengaged from the second-connecting-structure; wherein wherein the prayer device is configured as a releasably clippable prayer device, the releasably clippable prayer device having (i) an open-state when the second end of the hoop-component is disengaged from the second-connecting-structure and the at least one bead is retained on the hoop-component via the blocker, and (ii) a closed-state when the second end of the hoop-component is releasably engaged with the second-connecting-structure.

2. The device of claim 1, wherein the first-connecting-structure and the second-connecting-structure are located at diametrically opposed end-portions of the multi-point connector.

3. The device of claim 1, wherein the first-connecting-structure comprises a first-female attachment structure being configured to receive the first end of the hoop-component.

4. The device of claim 1, wherein at least the second-connecting-structure comprises a second-female attachment structure being configured to receive the second end of the hoop-component.

5. The device of claim 1, wherein the first-connecting-structure is configured to permanently engage the first end of the hoop-component.

6. The device of claim 5, wherein the first-connecting-structure is configured to permanently engage the first end of the hoop-component via (i) one or more crimps forming an inwardly deformed portion of the first-connecting structure configured to mechanically engage and compress the first end of the hoop-component defining a corresponding deformed portion of the first end of the hoop-component; (ii) adhesive disposed between the first-connecting-structure and the first end of the hoop-component; (iii) a soldered portion between the first-connecting-structure and the first end of the hoop-component; or any combination thereof.

7. The device of claim 1, wherein the hoop-component comprises a rigid or semi-rigid wire.

8. The device of claim 7, wherein the hoop-component is not freely flexible such that the hoop-component maintains a substantially identical or unchanged configuration upon rotation in any direction.

9. The device of claim 1, wherein the hoop-component comprises a metallic material.

10. The device of claim 1, wherein the at least one bead mounted on the hoop-component comprises a plurality of individual beads directly or indirectly mounted on the hoop-component.

11. The device of claim 1, wherein the multi-point connector further comprises a bottom portion including a third-connecting-structure.

12. The device of claim 11, wherein the third-connecting-structure is located between the first-connecting-structure and a second-connecting-structure.

13. The device of claim 12, wherein the third-connecting-structure comprises a third-female attachment structure being configured to receive one or more separate pendants, charms, chains, coupling-link, or combinations thereof.

14. The device of claim 13, wherein the third-connecting-structure comprises a ring-structure including a hole configured for direct or indirect engagement by one or more separate pendants, charms, chains, coupling-link, or combinations thereof.

15. The device of claim 13, further comprising one or more separate pendants, charms, chains, coupling-link, or combinations thereof directly or indirectly attached to the third-connecting-structure.

16. The device of claim 1, wherein the multi-point connector further comprises a top portion including a fourth-connecting-structure, wherein the fourth-connecting-structure is located centrally between the first-connecting-structure and the second-connecting-structure.

17. The device of claim 16, further comprising one or more separate pendants, charms, chains, cords, coupling-link, or combinations thereof directly or indirectly attached to the fourth-connecting-structure.

18. The device of claim 17, further comprising a coupling-link engaged through a top-hole of the fourth-connecting-structure and directly or indirectly attached to the one or more separate pendants, charms, chains, cords, or combinations thereof, and further comprising a claw clip releasably engaged with the coupling-link and a chain.

19. The device of claim 1, wherein the blocker is soldered onto the hoop-component.

* * * * *